United States Patent [19]

Lacaze, Jr.

[11] 4,345,373

[45] Aug. 24, 1982

[54] METHOD OF MANUFACTURE OF LOW-COST, HIGH QUALITY LOW INSERTION FORCE ELECTRICAL CONNECTOR SOCKET

[75] Inventor: Leonard Lacaze, Jr., San Juan Capistrano, Calif.

[73] Assignee: International Telephone and Telegraph Corporation, New York, N.Y.

[21] Appl. No.: 144,789

[22] Filed: Apr. 28, 1980

Related U.S. Application Data

[60] Continuation-in-part of Ser. No. 951,182, Oct. 13, 1978, abandoned, which is a division of Ser. No. 850,629, Nov. 11, 1977, abandoned.

[51] Int. Cl.[3] ..... H01R 43/00

[52] U.S. Cl. ..... 29/874; 72/367; 339/258 R

[58] Field of Search ..... 29/874, 885; 72/367; 339/258 R, 258 A, 258 RR

[56] References Cited

U.S. PATENT DOCUMENTS 2,563,760 8/1951 Uline ..... 339/258 R
3,257,636 6/1966 Van Horssen ..... 29/874 X

FOREIGN PATENT DOCUMENTS 1463783 12/1966 France ..... 339/258 R
2318519 3/1977 France ..... 339/258 R

*Primary Examiner*—Carl E. Hall
*Attorney, Agent, or Firm*—Thomas L. Peterson

[57] ABSTRACT

An electrical connector socket, particularly for electrical connectors comprising a plurality of pin and socket connections in mating connector assemblies. The conductive socket members, according to the invention, are generally tubular with axial slitting extending from the aperture to form a split-tine arrangement. The converging internal shape of the socket member, according to the invention, is produced by machining, drawing, or other processes not affecting the uniform stress/strain characteristics at the root of the tines. The lateral friction force gripping a pin inserted into the aperture of the socket member is thereby made more predictable and uniform from sample-to-sample, allowing the design of a low-insertion force, multicontact connector.

10 Claims, 14 Drawing Figures

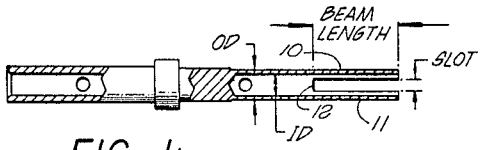
FIG. 1A
FIG. 1B
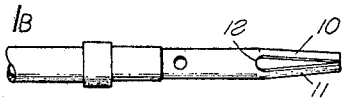
FIG. 1C
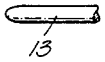
PRIOR ART
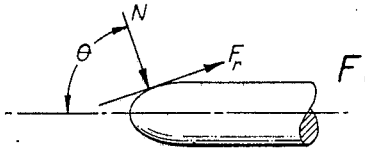
FIG. 2A
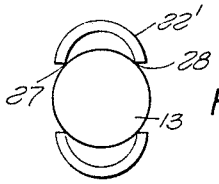
FIG. 3A
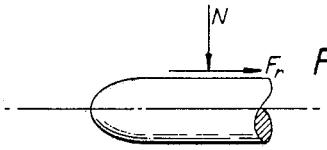
FIG. 2B
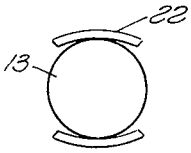
FIG. 3B
FIG. 4A
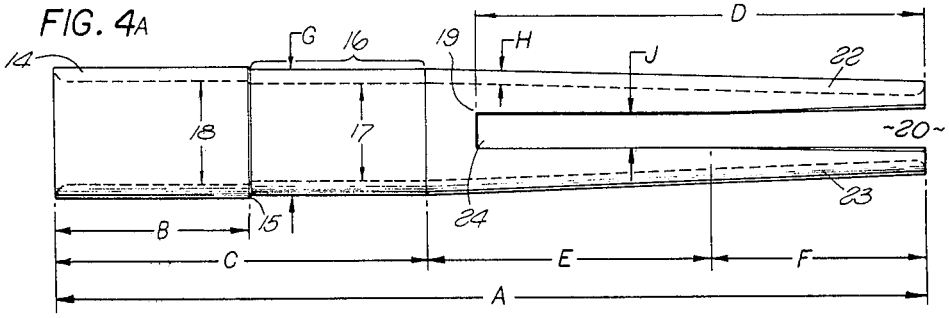
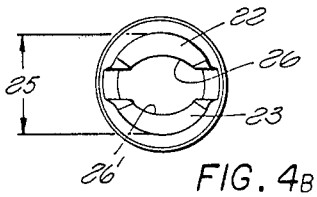
FIG. 4B
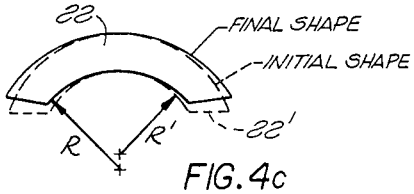
FIG. 4C

METHOD OF MANUFACTURE OF LOW-COST, HIGH QUALITY LOW INSERTION FORCE ELECTRICAL CONNECTOR SOCKET

CROSS REFERENCE TO OTHER APPLICATIONS

This is a continuation-in-part of copending U.S. patent application Ser. No. 951,182 filed Oct. 13, 1978, now abandoned which is a division of copending U.S. Pat. application, Ser. No. 850,629 filed Nov. 11, 1977, now abandoned. This application is also related to my copending application Ser. No. 091,960, filed Nov. 7, 1979, now U.S. Pat. No. 4,293,181, which has the same parent application as this application.

BACKGROUND OF THE INVENTION

1. Field of the Invention

The invention relates generally to socket and pin electrical connectors and, more specifically, to low-insertion force connectors of the type.

2. Description of the Prior Art

In the prior art, the tubular electrical socket contact with split tines is familiar and has been widely employed. Ordinarily, the process of manufacturing the individual socket members, a plurality of which may be included in a multi-connection electrical connector, have been manufactured by processes including a step of bending or deforming the tines in a radially inward fashion. This constricts the aperture of the socket to an effective diameter less than that of the pin such that when a mating pin is inserted therein, a substantial frictional gripping force is exerted against it. Usually, there is some flaring of the tines outwardly at the aperture or, in other cases, a small amount of countersink is put into the insulating body block holding the socket connector members to provide some guidance, compensating for slight pin misalignments as the connectors are mated.

Typical prior art sockets are extensively described in the technical and patent literature, for example, in U.S. Pat. No. 3,286,222 and in the drawings of U.S. Pat. No. 3,043,925. The socket members in those patents are of the crimped or bent-tine types. Those conventional socket contacts exhibit several sensitive parameters that adversely effect the achievability of repeatable, low insertion force while maintaining satisfactory contact pressure. Those areas of concern are: the modulus of elasticity (or Young's modulus) of the material; length of the beam (considering the tines as cantilevered beams); the moment of inertia of the beam representing the tines (governed by socket outside diameter, inside diameter and slot width); beam deflection called for by the design; and, finally, frictional characteristics of the pins within the sockets.

Forces resisting the mating of the pin and socket are essentially frictional forces arising from the socket tines, producing a normal force; i.e., a frictional force, on the pin. These forces, applied by the socket tines, are more thoroughly analyzed hereinafter. Suffice it to say at this point in the description, that a particular minimum amount of normal force is necessary to assure proper electric conduction. Normal forces in excess of this minimum, however, contribute little to electric conduction but still increase the insertion forces.

In the manufacture of the individual socket members according to prior art methods, the crimping or bending of the tines radially inward produces plastic (inelastic) deformation of the tines at their roots; i.e., adjacent to the inward extremity of the slots which are cut in to produce the tines themselves from the tubular body of the material. Not only does this operation result in work-hardening of the material in the root area, it does so in a relatively unpredictable fashion and nonuniformly with respect to the inside and outside fibers of the tine roots, these being subjected to compressive and tensile deformation, respectively.

Since the pin-gripping force achievable, according to the aforementioned prior art manufacturing method, is highly variable; therefore, in order to insure the least minimum pin-gripping force for all connections, overdesign in that respect is the usual approach. Thus, particularly in the connector assembly involving the substantial number of socket members, the overall insertion force can be quite large.

The manner in which the invention overcomes the disadvantages of the prior art by providing a unique socket structure, manufactured in accordance with a novel process, will be understood as this description proceeds.

SUMMARY OF THE INVENTION

It may be said to have been the general objective of the invention to produce electrical connector socket members which exhibit highly controllable and repeatable pin-gripping force which may be minimized without the risk of encountering unacceptably low values in one or more socket members where a plurality of these are assembled in a multicontact connector arrangement. The connector assembly may thereby be designed for low insertion force.

The configuration of the socket, according to the invention, beginning on the end opposite the pin aperture end, comprises a first section of essentially tubular (thin-walled, hollow, cylindrical) portion followed by a second section of converging inside and outside diameters (thin-walled conical section) and, finally, into a third or aperture section, modified from the conical convergence to make the cross-section oblate at rest and circular to a larger radius at pin insertion. The reasons for this partial flattening and the method of achieving it will be more thoroughly understood as this description proceeds. The slotting, which forms the tines from the tubular socket walls, comprises two opposite slots bisected by the major diameter of the oblate cross-section formed as aforementioned; in the two-tine preferred embodiment. It may be noted at this point that the partial flattening of each tine is accomplished over an axially length sufficient to accommodate a full insertion of the mating pin; but as a process step, bracing or blocking of the slot outward from the tine roots is provided during the flattening operation to prevent plastic deformation in the vicinity of the tine roots.

The so-called flattening operation produces the oblate shape. It will be realized that the tubing stock from which the part is manufactured, either by machining operations entirely or by a combination of drawing and machining, produces an aperture end of reduced inside and outside diameter as a result of the conical shaping operations hereinabove described. Accordingly, the flattening operation restores the tine aperture end (for a distance accommodating the pin insertion) radius of curvature to that of the pin.

The structure and manufacturing processes of the invention will be more fully understood as this description proceeds. It will be realized that the pin insertion force in a socket member, according to the invention, can be minimized, because the radially outward deflection of the tines produces a resilient gripping force based on more predictable parameters; i.e., more satisfactorily controlled modulus of elasticity and wall thickness of the socket tines at their roots, these being the principal factors governing the frictional pin-gripping force. The tines are tantamount to cantilevered beams of spring-like material, as will be seen from the description hereinafter.

BRIEF DESCRIPTION OF THE DRAWINGS

FIG. 1A is a cross-sectional view of a typical prior art connector socket member prior to tine crimping or bending.

FIG. 1B is a pictorial of a socket member such as in FIG. 1A after the tine bending operation has been accomplished.

FIG. 1C depicts a typically shaped mating pin insertable in the facing (aperture) end of the socket of FIG. 1B.

FIGS. 2A and 2B illustrate insertion force and frictional pin-gripping forces, respectively.

FIGS. 3A and 3B illustrate the need for and form of the typical tine partial flattening from the aperture end of the socket according to the invention before flattening and after flattening, respectively.

FIG. 4A is a side view of a typical socket member according to the invention.

FIG. 4B is an aperture end view of FIG. 4A.

FIG. 4C is an enlarged end view of a tine of the socket of FIG. 4A further illustrating the partial flattening operation which produces the oblate tine cross-section evident from FIG. 4B.

DESCRIPTION OF THE PREFERRED EMBODIMENT

Figure 5:
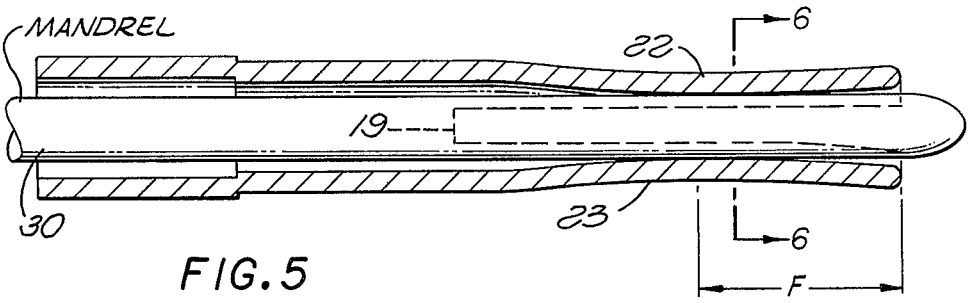
FIG. 5 is a partial longitudinal sectional view of the socket with a mandrel inserted into the rear end thereof which is used in the partial flattening of the tines of the socket.

Referring now to FIG. 1, the cross-sectional view is of a typical prior art socket member before the bending of the tines is effected. The generally tubular walls of the socket are axially slotted to a depth 12, producing tines 10 and 11. The OD (outside diameter) of the aperture end may be essentially that of the stock, the same applying to the ID (inside diameter). The beam length in FIG. 1A is of significance throughout the description, this representing the equivalent cantilevered beam represented by each of the tines. The tine root area around 12 is obviously the area of maximum stress as the tines are flexed in operation or when they are inwardly bent as part of the prior art manufacturing process, as illustrated in 1B. Insertion of the pin 13 of FIG. 1C flexes the tines 10 and 11 in FIG. 1B radially outward so that they effectively assume a "sprung-out" position gripping the pin 13 along their internal surfaces.

As hereinbefore indicated, a manufacturing step involving the radially inward bending of the tines produces the configuration of 1B and involves a plastic (inelastic) deformation in the tine root region. This produces work-hardening of the copper base material in the said root region, but not at all uniformly throughout the tine roots. As previously indicated, the inside fibers of each tine are compressed, whereas the outside fibers are deformed plastically as a result of tensile overstressing. By overstressing, it is, of course, meant that the material exceeds its yield point and takes on a "permanent set." As also previously indicated, this prior art manufacturing technique results in large variations in contact, force and, therefore, also in insertion force, leading to the necessity for acceptance of a high average force in a production lot of such sockets in order to assure that all will have at least the minimum necessary pin-gripping force. The only practical alternate in using the prior art approach is individual inspection and selection of those providing the minimum acceptable, but not an excessive, amount of insertion resistance.

FIGS. 2A and 2B are helpful in understanding the geometry of insertion forces and pin-contact friction. Upon pin entry into the socket aperture, the mating force is defined by the relationship depicted in FIG. 2A and may be expressed as:

$$\text{Mating Force} = R(N \cos\theta + F_r \sin\theta)$$

Once the pin is well within the socket, the mating force may be defined as the product of R and $F_r$, where:

$F_r = \mu N$
R = number of tines
N = normal force
$\mu$ = coefficient of friction Referring now to FIG. 4, a typical socket according to the invention will be described. One practical embodiment according to FIG. 4A has the following dimensions:

A = 0.353/0.350
B = 0.083/0.080
C = 0.153/0.150
D = 0.182/0.180
E + Fω0.200
G = 0.0495/0.0485
H = 0.0060/0.0055
J = 0.014/0.013

The socket member of FIG. 4A has a sleeve portion 14 of axial length B. The inside diameter 18 of this portion 14 may be greater than indicated on a relative visual scale, as might the corresponding outside diameter also be larger than indicated. The purpose of 14 is to provide a wire installing sleeve or, alternatively, a sleeve for receiving an intermediate stub or adaptor which is itself attached to a wire. The purpose, in turn, of providing such an intermediate stub is the avoidance of any crimping of the sleeve 14. The entire socket member according to FIG. 4A is of a material, preferably a copper alloy having significant spring properties, good machinability, ductility and conductivity. However, such an alloy may not be ideal for crimping at sleeve 14, hence the intermediate stub alternative, the latter being tightly inserted (press-fit, for example) into the bore 18 of 14.

A shoulder which may be chamfered is shown at 15, simply to facilitate mounting against a corresponding internal shoulder in a connector assembly insulating block, a typical expedient in electrical connectors.

A transition of mid-body section 16 having an inside diameter 17 also has an outside dimension G. Its length is equal to C–B and ID 17 is greater than a mating pin clearance dimension, although the pin would not always be inserted to a depth even as great as the full length of dimension D.

So far, the manufacturing process can be one of straightforward machining operation.

Over the dimensions E and F, during manufacture, the stock may be advantageously drawn into a die having the conical shape which begins at the transition from 16 to E and F. A drawing process is particularly advantageous from the point of view that the tine root region around 19 may be formed with closely held material thickness (tubular wall thickness), that being an important factor in controlling the characteristics of the tine considered as a cantilevered beam as aformentioned. Typical dimension H will be seen to call for holding this wall thickness within a 0.0005 range.

Of course, drawing does introduce work hardening, but it is relatively uniform over the material cross-section and is predictable and controllable. Thus, the amount of work hardening introduced by drawing can be predicted and, therefore, factored into the design.

The next step in the process of manufacture would normally be the slotting by cutting, or other known process step, to the depth D and width J. At this step, the slot of width J would continue to the aperture of the socket 20. Tines 22 and 23 are thereby formed.

In lieu of drawing, however, full machining operations can be used to complete the process, those machine processes being largely adapted to automatic sequential screw machines.

The process thus far described and the structure which would result would produce the situation depicted in FIG. 3A. The tines which would be generated obviously have the smaller circular cross-section produced by the conical shaping hereinbefore described. In FIG. 3A, 22' illustrates this fact, and it will be noted the contact with the pin 13 is limited to two edges 27 and 28. Thus, not only would the spring tines tend to score the pin, but the area of contact between socket end pin is unduly limited thereby. By partially flattening the tines at their aperture ends and for a distance of F in FIG. 4A, the contact area can be shifted more or less to the circumferential inside center surfaces of the tines. The illustrations in FIGS. 3A and 3B are obviously exaggerated for emphasis; however, this situation is more realistically portrayed in the partial end view of FIG. 4C. Thus, the tines, 22 for example, in FIG. 4A, have a longer radius, no longer centered on the axial center line of the socket aperture. This is illustrated in FIG. 4C in that the radius R' of the unflattened tine 22' changes to R for the reshaped tine 22.

FIG. 3B would indicate that the flattening is such as to produce an effective tine radius greater than the radius of pin 13. This is a possible construction or design choice; however, the radius may be as small as substantially that of the pin 13 itself.

The partial flattening, as it has been called, referring to the process of modifying 22' to the form of 22 for a predetermined distance inward from the socket aperture, is actually a change of curvature and not actually a flattening in the ordinary sense of that adjective and, as such, does represent plastic deformation. In that connection, it is pointed out that bending or flattening action which achieves this change of curvature is accomplished with insertion of a mandrel into the socket aperture or through the socket body from the rear to block the tines thereby preventing the application of sufficient bending moment to the tine root region during the flattening to cause the plastic deformation to the tine root region, which is particularly to be avoided.

The plastic deformation thus produced by tine end curvature modification plays no part in the design insofar as insertion and pin frictional forces are concerned, since the new curvature R, once achieved, is a fixed shape.

FIG. 4B illustrates that the outline of the socket aperture after this so-called flattening operation is an oblate circle; i.e., one in which the dimension 25 is less than the orthogonal dimension of the aperture at the same axial point (same cross-sectional plane). When the pin is inserted into this aperture, the radii of the surfaces of 26 and 26' are at least equal to that of the pin, if not greater.

Figure 6:
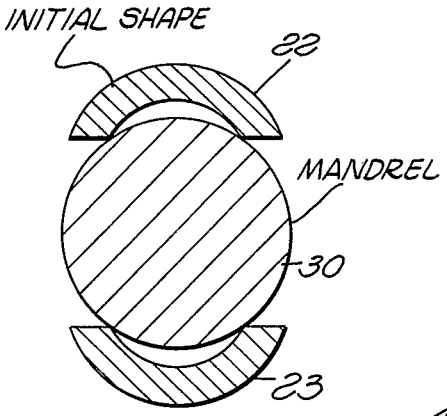
FIG. 6 is an enlarged transverse sectional view taken along line 6—6 of FIG. 5 showing the tines before they are partially flattened.

Reference is now made to FIGS. 5–8 which illustrate a preferred method for partially flattening the tines of the socket. FIG. 5 illustrates a cylindrical mandrel 30 inserted into the socket of FIG. 4A before the tines are flattened. The mandrel is shown as being inserted from the rear of the socket. The diameter of the mandrel is greater than the diameter of the socket at its forward aperture end. If the forward end of the mandrel is curved (as shown) or pointed, it could also be inserted into the socket from the front end thereof. The diameter of the mandrel must be at least as great as that of the mating pin 13 for the socket, and preferably greater since the tines will tend to spring back due to their resilience after being compressed around the mandrel. Thus, the diameter of the mandrel is dependent upon the diameter of the pin 13, the modulus of elasticity of the tines of the socket and the yield point of the material. In addition, the diameter of the mandrel must be somewhat less than the internal diameter of the socket at the tine root region 19 to avoid plastic deformation of the socket at such region when the mandrel is pushed into the socket. Preferably the diameter of the mandrel will be the same as the internal diameter of the socket at a point closely behind the commencement of the distance F and somewhat remote from the tine root region 19 of the socket. Since the diameter of the mandrel is greater than the internal diameter of the aperture end of the socket, the forward ends of the tines 22 and 23 flair outwardly as seen in FIG. 5. FIG. 6 illustrates in cross-section the configuration of the tines relative to the mandrel prior to the flattening operation.

Figure 7:
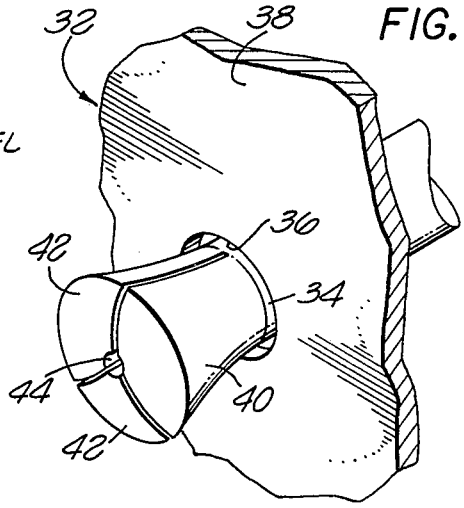
FIG. 7 is a fragmentary perspective view of a collet assembly used to flatten the tines.
Figure 8:
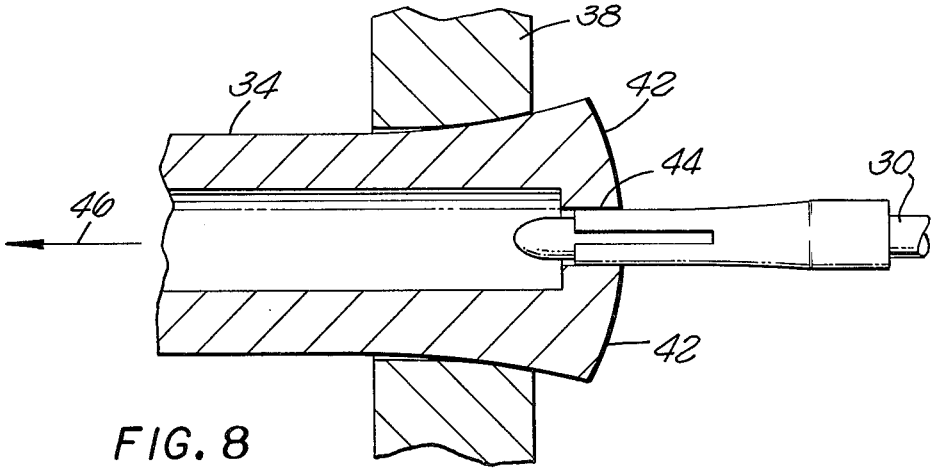
FIG. 8 is a fragmentary, partial longitudinal sectional view showing the socket-mandrel assembly of FIG. 5 inserted into the collet assembly.

FIG. 7 illustrates a collet assembly 32 which is utilized to compress the tines 22 and 23 around the mandrel 30. The assembly 32 comprises a standard lathe collet 34 which extends through an opening 36 of a disc 38. The end 40 of a collet tapers outwardly and is longitudinally slotted at three points 120° apart to provide three independently movable jaws 42, the inner edges of which define a cylindrical bore 44. As seen in FIG. 8, the mandrel and socket assembly of FIG. 5 is inserted into the bore 44 from the front of the collet until the length F of the socket lies within the bore. The collet is then shifted in the direction of the arrow 46 in FIG. 8 drawing the tapered end 40 of the collet into bearing engagement with the wall of the opening 36 in disc 38 whereby the jaws 42 are forced inwardly to compress around the ends of the tines of the socket, thus deforming them over the mandrel. Thereafter, the collet is shifted in the reverse direction relative to the disc 38 so that the mandrel and socket may be removed from the collet. Upon removal of the socket, the ends of the tines will spring back to the final shape illustrated in FIG. 4C. Since the diameter of the mandrel is chosen so that no plastic deformation will occur to the tine root region of the socket when the mandrel is inserted therein and the collet compresses only the ends of the tines around the mandrel during the tine flattening operation, the tine root region of the socket is not distorted as occurs in the prior art method of forming a socket as shown in FIG. 1.

Various modifications in the axial proportions and dimensions of a socket member according to the invention are obviously possible without departing from the structural concepts and manufacturing methods which form the invention. Other dimensional and configuration freedoms will obviously be possible. The socket may obviously be scaled to be consistent with an application.

In an alternative embodiment of the method of the invention, when the tubular stock is initially drawn to form the conical taper over distances E and F, the tapered section may be provided with an oblate circular configuration in transverse cross-section (such as seen in FIG. 4B) by the use of a suitably shaped die, not shown. Thus, the partial flattened configuration for the tines 22 and 23 is provided prior to the slotting operation, thereby eliminating the additional tine flattening operations depicted in FIGS. 5–8.

In view of the possibility for modifications and variations falling within the spirit and scope of the invention, the drawings and this description are to be regarded as typical and illustrative only.

What is claimed is:

1. The method of manufacture of a low insertion force electrical connector socket, comprising:

forming a length of generally tubular stock to have a generally conical inside and outside taper over a first predetermined distance (E & F) from a first end thereof;

thereafter axially slotting the side walls of said tubing from said first end to a second predetermined distance (D), said second distance not exceeding said first distance, said slotting forming a pair of tines of length equal to said second distance from said first end to a tine root region; and partially flattening said tines while preventing plastic deformation of said tines at said root region, said partial flattening being such as to substantially modify the inside radius of said tines at least to that of said tubular stock prior to said forming operation over a third predetermined axial distance (F) from said first end, said third predetermined distance (F) being less than said second predetermined distance (D).

2. The method according to claim 1 in which said forming operation is defined as drawing.

3. The method according to claim 1 in which said forming operation is defined as a machining operation.

4. The method according to claim 1 in which said step of preventing plastic deformation of said tine root region during said partial flattening of said tines comprises blocking of said tines to prevent their substantial radially inward deflection, said blocking being applied within said third predetermined axial distance.

5. The method of manufacturing an electrical connector socket having an aperture end for receiving a conductive pin of substantially uniform circular cross-section in response to a relatively low axial insertion force, comprising:

forming a generally tubular socket body of resilient metal with a first body portion of first predetermined axial length (C) and of predetermined cross-sectional characteristics for a fixed connection interface;

forming a second portion of said socket body for a second predetermined axial length (E & F) extending from said first body portion toward said aperture end as a right, circular, conical shell having a conical inside and outside taper, and converging to a diameter reduced at said aperture end as compared to the largest cross-sectional diameter of said conical shell, body portion;

thereafter cutting at least two axially extending, equally circumferentially spaced slots through the wall thickness of said second body portion to produce bifurcation of said second body portion from said aperture end, the plural tines thereby provided being of third predetermined length (D) not greater than said second predetermined length, the nonaperture ends of said slots terminating to produce a tine root region, the modulus of elasticity of said root region being thereby not subjected to nonuniform work hardening.

6. The method of manufacture of a low insertion force electrical connector socket, comprising:

forming a length of generally tubular stock to have a generally conical inside and outside taper over a first predetermined distance (E & F) from a first end thereof; and thereafter axially slotting the side walls of said tubing from said first end to a second predetermined distance (D), said second distance not exceeding said first distance, said slotting forming a pair of tines of length equal to said second distance from said first end to a tine root region whereby plastic deformation of said tines at said root region is avoided.

7. The method according to claim 6 wherein:

said tines are formed to have a generally oblate circular configuration in transverse cross-section over a third predetermined axial distance (F) from said first end, said third predetermined distance (F) being less than said second predetermined distance (D).

8. The method according to claim 7 wherein:

said tines are formed to have said oblate circular configuration by partially flattening the tines after said slotting step.

9. The method according to claim 7 wherein:

said tines are formed to have said oblate circular configuration by providing an oblate configuration to the tapered section of said tubular stock when initially forming said taper.

10. The method according to claim 6 wherein:

said forming of said tubular stock is performed by drawing the stock.

* * * * *